United States Patent [19]

Keegan

[11] Patent Number: 4,933,097

[45] Date of Patent: Jun. 12, 1990

[54] FABRIC CONDITIONERS CONTAINING ALKYL SUBSTITUTED SILOXANE

[75] Inventor: Sandra A. Keegan, Middlesex, England

[73] Assignee: BP Chemicals Limited, London, England

[21] Appl. No.: 268,054

[22] Filed: Nov. 7, 1988

[30] Foreign Application Priority Data

| | | | |
|---|---|---|---|
| Nov. 19, 1987 | [GB] | United Kingdom | 8727137 |
| Dec. 18, 1987 | [GB] | United Kingdom | 8729536 |
| Jul. 27, 1988 | [GB] | United Kingdom | 8817887 |

[51] Int. Cl.[5] ..... D06M 15/64; D06M 13/46

[52] U.S. Cl. ..... 252/8.8; 8/137; 252/8.6; 252/8.9

[58] Field of Search ..... 252/8.8, 8.9

[56] References Cited

U.S. PATENT DOCUMENTS

| | | | |
|---|---|---|---|
| 3,748,275 | 7/1973 | Bernheim et al. | 252/312 |
| 3,803,284 | 4/1974 | Burghard et al. | 264/130 |
| 4,127,489 | 11/1978 | Pracht et al. | 252/8.8 |
| 4,421,796 | 12/1983 | Burril et al. | 252/8.8 |
| 4,448,810 | 5/1984 | Westall | 252/8.8 |
| 4,661,269 | 4/1987 | Trinh et al. | 252/8.8 |

FOREIGN PATENT DOCUMENTS

| | | |
|---|---|---|
| 953058 | 8/1974 | Canada . |
| 1175234 | 12/1969 | United Kingdom . |
| 1549180 | 7/1979 | United Kingdom . |

*Primary Examiner*—A. Lionel Clingman

*Attorney, Agent, or Firm*—Brooks Haidt Haffner & Delahunty

[57] ABSTRACT

A composition comprising (a) a quaternary ammonium halide or an imidazolinium methosulphate (40-98 wt. %) and (b) a non-ionic siloxane of the formula:

$$(CH_3)_3Si[OSi(CH_3)_2]_m[OSi(CH_3)(R_1)]_p[[OSi(CH_3)(R_2)]_q[OSi(CH_3)(H)]_r-OSi(CH_3)_3 \quad (I)$$

wherein $R_1=(CH_2)_tCH_3$ $R_2$=—H, $CH_3$ or $-(CH_2)_z(OCH_2CHR_3)_x(OCH_2CHR_4)_y-OR_5$ in which each of $R_3$ and $R_4$ represent an H or a $-CH_3$ group such that the resultant polyoxyalkylene derivative is a polymer of ethylene oxide, or, a random and/or block copolymer of ethylene oxide and propylene oxide, $R_5$=H, $C_1$–$C_4$ alkyl or an acetoxy group, x=1–50 y=0–40 z=1–10 t=5–21 m=5–1000 n=1–100 q=1–50 and r=1–50.

12 Claims, No Drawings

FABRIC CONDITIONERS CONTAINING ALKYL SUBSTITUTED SILOXANE

This invention relates to fabric conditioning formulations containing siloxanes.

Fabric conditioning formulations are usually aqueous based, contain a water dispersible cationic softener, a non-ionic surfactant and an electrolyte which enables the viscosity of the formulation to be controlled.

GB 1549180 describes the use of a cationic softener and a linear $C_1$–$C_5$ alkyl substituted polysiloxane as a textile treating composition to soften the fabric treated and to facilitate ironing of the treated fabric.

It has now been found that good fabric conditioning formulations may be formed by using a specific non-ionic softener without adversely affecting the fabric being softened or the softening process.

It has further been found that by using a higher alkyl substituent in the polysiloxane component, the rewettability of the washed fabric is improved.

Accordingly, the present invention is an aqueous based fabric conditioning formulation comprising a water dispersible cationic softener, a non-ionic softener and optionally an electrolyte, characterised in that the non-ionic softener comprises a siloxane of the formula:

$$(CH_3)_3Si[OSi(CH_3)_2]_m[OSi(CH_3)(R_1)]_p[OSi(CH_3)(R_2)]_q[OSi(CH_3)(H)]_rOSi(CH_3)_3 \quad (I)$$

$R_1=(CH_2)_tCH_3$ $R_2=$—H,—$CH_3$ or —$(CH_2)_z(OCH_2.CHR_3)_x(OCH_2CHR_4)_y$—$OR_5$ in which each of $R_3$ and $R_4$ are H or a —$CH_3$ group such that the resultant polyoxyalkylene derivative is a polymer of ethylene oxide and/or a random or block copolymer of ethylene oxide and propylene oxide, $R_5$=H, a $C_1$–$C_4$ alkyl or an acetoxy group, x=1–50 y=0–40 z=1–10 t=5–21 m=5–1000 p=1–100 q=1–50 and r=0–10

The siloxanes (I) used as fabric conditioners are derivable by the reaction of a siloxane with an olefin and excess alkylene oxide. However, the product of this reaction may be used directly as the fabric conditioner even though such a product may be a mixture of (I) and some unreacted or partially reacted materials. In such a product the siloxane (I) is the predominant component. Thus, for instance, if the reaction of all —OSi(H)($CH_3$)—groups in the siloxane with the alkylene oxide is complete, the value of r can be O in formula (I) because this will represent the absence of any unreacted —O-SI($CH_3$)(H)—groups in the siloxane used.

In compounds of the formula (I), the preferred compounds have the following values for the various notations used:

m=10–120 p=5–40 q=1–6 r=0–5 x=5–15 y=1–10 z=2–5 t=9–19

$r_3$ is H $R_4$ is —$CH_3$, and $R_5$ is H or —$CH_3$

The non-ionic siloxane is suitably used in conjunction with conventional water-dispersible cationic softeners such as the quaternary ammonium halides or the imidazolinium methosulphates.

Thus, according to a further embodiment the present invention is an aqueous based fabric conditioning formulation comprising:

(a) a water-dispersible cationic softener selected from (i) dihydrocarbyldialkylammonium salt of the formula:

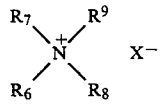

(II)

wherein $R_6$ and $R_7$ are the same or different $C_8$ to $C_{24}$ alkyl or alkenyl groups, which may optionally carry additional functional groups selected from —OH, —O—, —CONH and —COO— either as substituents or as part of the main alkyl or alkenyl chain, $R_8$ and $R_9$ are the same or different $C_1$–$C_4$ alkyl, hydroxyalkyl or (poly)oxyalkylene groups, and $X^-$ is an anion selected from a halide, methosulphate and ethosulphate, (ii) an alkylimidazolinium salt of the formula (III):

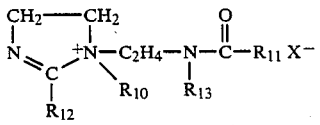

(III)

wherein $R_{10}$ is a $C_1$–$C_4$ alkyl or hydroxyalkyl or (poly)oxyalkylene group, $R_{11}$ and $R_{12}$ are the same or different alkyl or alkenyl groups containing from 8 to 24 carbon atoms, and $R_{13}$ is hydrogen, a $C_1$–$C_4$ alkyl or a —CO—$R_{11}$ group and $X^-$ is an anion, selected from a halide, methosulphate or ethosulphate, (iii)

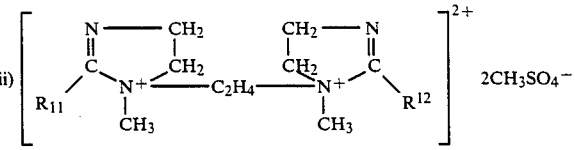

(IV)

-continued (iv) $$\left[R_{11}-CO-NH-C_2H_4-\underset{\underset{CH_3}{|}}{\overset{\overset{R_{14}}{|}}{N}}{}^{+}-C_2H_4-NH-CO-R_{12}\right]^{+} CH_3SO_4^- \quad (V)$$

wherein $R_{14}$=H, alkyl, hydroxyalkyl or (poly)oxyalkylene and (b) a siloxane of formula (I) as defined above, and optionally (c) an electrolyte.

Examples of these cationic softeners of formula (II) above include: dieicosyldimethyl ammonium chloride; didocosyldimethyl ammonium chloride; dioctadecyldimethyl ammonium chloride; dioctadecyldimethyl ammonium methosulphate; ditetradecyldimethyl ammonium chloride and naturally occurring mixtures of above fatty groups, e.g. di(hydrogenated tallow) dimethyl ammonium chloride; di(hydrogenated tallow) dimethyl ammonium methosulphate; ditallow dimethyl ammonium chloride; and dioleyldimethyl ammonium chloride. Di(hydrogenated tallow) dimethyl ammonium chloride or dioctadecyl dimethyl ammonium chloride is preferred.

In a formulation containing both components (a) and (b) above if the component (a) is represented by formula (II) each of $R_6$ and $R_7$ suitably represent a substituent in which more than 50%, preferably more than 75%, of the groups are $C_{12}$ to $C_{18}$ alkyl or alkenyl groups. More preferably, each of the substituent groups $R_6$ and $R_7$ represent a mixture of alkyl and alkenyl groups, namely from 50–90% $C_{18}$ alkyl or alkenyl groups and from 10 to 50% $C_{16}$ alkyl or alkenyl groups.

Thus, the substituents $R_6$ and $R_7$ are most preferably represented by dioctadecyl groupings, the substituents $R_8$ and $R_9$ are preferably methyl groups, and the anion $X^-$ is preferably a chloride.

Thus, the preferred component (a) of formula (II) is di(hydrogenatedtallow) dimethyl ammonium chloride or dioctadecyl dimethyl ammonium chloride.

Examples of the imidazolinium salts of formula (III) above include 1-methyl-1-(tallowylamido-) ethyl -2-tallowyl- 4,5-dihydro imidazolinium methosulphate and 1-methyl-1-(palmitoylamido)ethyl -2-octadecyl-4,5-dihydro-imidazolinium methosulphate. Other useful imidazolinium materials are 2-heptadecyl-1-methyl-1-(2-stearoylamido)-ethyl-imidazolinium methosulphate and 2lauryl-1-hydroxyethyl-1-oleyl-imidazolinium chloride. Such imidazolinium fabric softening components are described more fully in U.S. Pat. No. 4,127,489 and can be used in the formulations of the present invention.

The cationic quaternary salt components falling within (a) above are commercially available materials under the following trade names or Registered Trade Marks: Dehyquart DAM (ex Henkel et Cie); Arquad 2HT (ex AKZO); Prapagen WK (ex Hoechst); Noramium M2SH (ex CEKA); and the imidazolinium compounds falling within (a) are Rewoquat W7500H, Rewoquat W7500 and Rewoquat W3690 (all ex REWO), Casaquat 865 & 888 (ex Thomas Swan) and Blandofen CAZ-75 (ex GAF).

The formulations of the present invention may optionally include specific electrolytes to assist in controlling the viscosity of the product. The amount of electrolyte in the formulation is suitably from 0.01% to 0.5%, most preferably from about 0.02% to about 0.2%, measured as the anhydrous salt. Examples of electrolytes that may be used include lithium chloride, calcium chloride, magnesium chloride, aluminum chloride and mixtures thereof.

In the fabric conditioning formulations the components (a) and (b) suitably present in the following percentages by weight based on the total weight of (a) and (b):

(a) 40% to 98%

(b) 2% to 60%

Preferably (a) and (b) are present in the following weight percentages of the total weight of (a) and (b):

(a) 70% to 95%

(b) 5to 30%

Formulations according to the present invention if prepared as a pre-blend of (a) and (b) may be prepared by blending e.g. by mixing (b) with molten (a) at a temperature in the range 40° to 70° C.

The formulations according to the present invention, if prepared as a preblend of (a) and (b), may be dispersed in water with moderate shearing at elevated temperature, for example at about 40° to 70° C.

The total amount of (a) and (b) in the water is preferably from 2% to 10% by weight.

Thus, as another aspect of the present invention, a fabric conditioner comprises a total of 2% to 10% by weight of (a) and (b) in aqueous dispersion.

In such a composition (a) is present preferably in an amount from 2% to 6% by weight of the active content (75% active component +25% solvent) in the aqueous dispersion and (b) is present in an amount from 0.1% to 3% by weight of the active content in the aqueous dispersion.

Other components present in the formulation may include pigments, perfumes, preservatives and the like.

The formulations used in the present invention not only softens the fabrics treated, but also improves the rewettability and ironability of the treated fabrics.

EXAMPLE 1

Methods of preparing dialkyldimethylammonium chloride and siloxanes according to the present invention will be well known to those skilled in the art.

Softening Test 1 (Qualitative Evaluation)

Test Solution

Molten di(hydrogenatedtallow) dimethyl ammonium chloride (50–55° C.), where each of $R_6$ and $R_7$ in Formula (II)=64% $C_{18}$, 31% $C_{16}$ and 4% $C_{14}$ alkyl or alkenyl group, for example, Arquad 2HT (ex Akzo, Registered Trade Mark) was mixed under low shear conditions with a siloxane (I) in which the average values of m=84.7, p= 20.0, z=3, q=3.6, x=9.6, y=4.0, t=14 and where $R_3$=H, $R_4$ =$CH_3$, $R_5$=H as determined by $C^{13}$ and $Si^{29}$ nmr analysis. This siloxane was not analyzed for the presence of unreacted —O-Si($CH_3$)(H)—groups.

A dispersion was formed with moderate shearing in water heated to 60° C. and containing 3% by weight (active content) of the di(hydrogenated tallow) dimethyl ammonium chloride and 0.3% by weight of the siloxane.

When cool, 4g of this dispersion was further diluted with 996g of water to obtain a solution which simulated a typical concentration of fabric conditioner existing in a washing machine rinse cycle.

Comparative Solutions

Two comparative solutions were prepared by diluting 4g of 5% and 3% by weight (active content) aqueous dispersions of di(hydrogenated tallow) dimethyl ammonium chloride with 996g of water.

The test solution and the comparative solutions were used to soften the test cloths.

Preparation of Test Cloths

Three terry towelling cloths e.g. nappies (ex Boots) were boilwashed (95° C.) a total of five times using a heavy duty laundry detergent powder (e.g. Persil, ex Lever Bros., Registered Trade Mark) to remove any coating applied during manufacture. One cloth was submerged flat in the test solution and in each of the comparative solutions for 10 minutes and then tumble dried. When dry, each test cloth was divided into eight test pieces. The procedure was then repeated five times.

Softening Test Results

The softness of the test pieces was evaluated using panels of eight persons by means of a paired comparison test. Panel members were asked to compare the softness of each test piece with each other test piece, i.e. A vs B, A vs C and B vs C. The panellists were given three possibilities in the softening test, for example when comparing A and C:

A is softer than C—A scores 1, C scores 0

C is softer than A—A scores 0, C scores 1

A and C are identical—A scores ½, C scores ½

Scores for each cloth are totalled and the results from the five panel tests were:

| Results | 5% Arquad 2HT | 3% Arquad 2HT + 0.3% siloxane (I) | 3% Arquad 2HT |
|---|---|---|---|
| Panel Test 1 | 13.5 | 16.0 | 8.0 |
| Panel Test 2 | 19.5 | 18.5 | 3.5 |
| Panel Test 3 | 19.5 | 14.5 | 10.5 |
| Panel Test 4 | 16.0 | 14.5 | 15.5 |
| Panel Test 5 | 15.0 | 17.0 | 10.5 |
| Total Score | 83.5 | 80.5 | 48 |

Statistical treatment of the results (analysis of variance) show that the 5% Arquad 2HT and a mixture of 3% Arquad 2HT+0.3% siloxane have a softening action significantly superior to that of 3% Arquad 2HT when used alone. The siloxane improves the softening performance of 3% Arquad 2HT. There is no significant difference between the softening performance of 5% Arquad 2HT and a mixture of 3% Arquad 2HT+0.3% siloxane.

Improvement in Rewetting

Rewettability was measured in terms of the height to which a dye solution (Lissamine Fast Red B, ex BDH, 0.2% w/w solution in water) wicked up a strip of treated terry towelling (desized and treated as for softening test below) after 10 minutes. Statistical analysis of the results show that the siloxane used in the softening test below significantly improves rewettability.

| Test Piece | height of dye after 10 minutes (cm) 5% Arquad 2HT | 3% Arquad 2HT | 3% Arquad 2HT + 0.3% Siloxane (I) |
|---|---|---|---|
| No. 1 | 2.5 | 4.9 | 5.1 |
| 2 | 3.0 | 5.5 | 5.3 |
| 3 | 3.0 | 5.0 | 7.3 |
| 4 | 3.0 | 4.8 | 6.5 |
| 5 | 2.7 | 4.9 | 6.3 |
| 6 | 3.0 | 5.3 | 6.2 |
| 7 | 2.5 | 5.8 | 6.5 |
| 8 | 3.0 | 5.3 | 6.4 |
| 9 | 3.2 | 5.7 | 6.4 |
| 10 | 3.0 | 5.2 | 6.0 |
| Mean | 2.9 | 5.2 | 6.2 |

The above results show that not only does 3% Arquad 2HT+0.3% siloxane (I) have a softening action equivalent to 5% Arquad 2HT the siloxane (I) also improves rewettability.

EXAMPLES 2-5

Four specific compounds falling under the generic structure (I) shown below were tested for their fabric conditioning properties as follows:

$$(CH_3)_3Si[OSi(CH_3)_2][OSi(CH_3)(R_1)][OSi(CH_3)(R_2)][OSi(CH_3)(H)]OSi(CH_3)_3 \quad (I)$$

M D $D^1$ $D^{11}$ $D^{111}$ M in which $R_1$=—$(CH_2)_{15}$—$CH_3$ $R_2$=—$(CH_2)_3$—O—$(C_2H_4O)_{12}$—$(C_3H_6O)_4H$, M=$(CH_3)_3Si$ groups D=OSi(CHhd 3)$_2$ groups $D^1$=Osi(CHhd 3)($R_1$) groups $D^{11}$=OSi($CH_3$)($R_2$) groups and $D^{111}$=OSi($CH_3$)(H) groups.

The siloxanes tested had the following values upon analysis by gel permeation chromatography.

| Test Polyether | D | $D^1$ | $D^{11}$ | $D^{111}$ |
|---|---|---|---|---|
| W | 40 | 10.6 | 2.0 | 0.4 |
| X | 100 | 23.5 | 4.0 | 1.6 |
| Y | 13.5 | 4.5 | 0.9 | 0.2 |
| Z | 20 | 5.2 | 1.1 | 0.2 |

EVALUATION OF FABRIC CONDITIONING EFFICIENCY OF SILOXANE SAMPLES W,X,Y & Z

A comparison between the softening effect of standard dispersions (3% and 5% in water) of quaternary ammonium salts (quats) and quat dispersions (3%) containing additives (0.3%) of the present invention was carried out using the following method.

A. PREPARATION OF OUAT MIXTURES

1. Arquad-2HT (Regd. Trade Mark) was pre-warmed in an oven at 60° C. until free-flowing.
2. Water bath was set to 72° C.
3. Exactly the required amount of distilled water was weighed into a 2l glass reaction vessel which was placed in the water bath (2 clamps), stirring gently using a four-bladed metal propeller (6cm diameter) until the temperature of the water in the vessel was between 60° and 65° C.

4. The temperature of the water was noted and the required amount of quat added in 5–6g batches over 10–30 minutes, stirring the mixture at 300 rpm throughout the addition. The mobility of the quat solution was maintained by placing the stoppered quat bottle on a hotplate (low setting) between additions of quat.

5. After all quat was added, the temperature of the solution was noted. The solution was stirred, at the same rate, for a further 15 minutes, and allowed to cool, with gentle stirring, to room temperature.

6. Each quat dispersion was stored in a sealed plastic container.

Preparation of quat additive mixtures

The required ratio of quat and additive was mixed thoroughly, by hand, at a temperature (60°–65° C.) at which both materials are mobile. The amount required (weighed by difference) to give a 3% quat +0.3% additive dispersion was then treated as in A(4) above.

B. CLOTHS

The cloths used to monitor softening performance were hemmed 8"×8" pieces of 400 gsm Terry Towelling (bleached only).

C. PRE-HARSHENING OF CLOTHS 100 cloths were desized per Miele machine.

2. 5 cycles at programme 1 (for about 90 minutes at 95° C. on Miele washing machine) using exactly 120g New System Persil (Regd. Trade Mark) Automatic (hereafter NSPA) per cycle.

3. Cloths taken at random from each machine and tumble dried on programme 1 (100 cloths per Miele tumble drier).

4. Cloths placed into plastic storage bag.

D. TREATMENT OF CLOTHS (DISPOSABLE GLOVES USED THROUGHOUT)

1. Required number of cloths were taken from storage bag and washed once at 50° C. (exactly 120g NSPA) followed by a short spin (programme 4). This took approx 1.5 hours.

2. Water was added to the Hotpoint 9400 washing machine up to the lower (251) mark , and 100ml of the quat mixture added, carefully washing out the measuring cylinder with water from the 251. The quat was mixed in with 5 short bursts of the paddle. The temperature of the water was recorded to be ambient (5°–15° C.).

3. 8 cloths were added and agitated for 10 minutes ('max' mark on Hotpoint 9400 machine), squeezed gently, and transferred to the spin drier section of the machine and spun for 2 minutes.

4. The cloths were removed, tagged to indicate product tested and whether morning or afternoon treatment. The cloths were hung dried at 20° C., 60% relative humidity for 24 hours in the laboratory (cloths distributed randomly on clothes horses to eliminate differences in results due to inconsistent drying conditions). The temperature and relative humidity in the laboratory were recorded periodically.

5. The machine tubs were washed out with at least 2×51 of hot water, prior to the next run.

E. TEST WITH CLEAN BALLAST LOAD.

1. A more rigorous test was undertaken by including a clean ballast load in the wash and rinse cycles. The load was designed to match a typical wash load, and weighed approximately 2.5kgs and consisted of approximately 50/50 cotton/synthetic.

2. The ballast loads consisted of;

4 cotton Terry hand-towels 830g
2 1-meter knitted acrylic piecss 920g
2 1-meter plain cotton pieces 280g
2 2-meter polyester pongee pieces 200g
2 1-meter knitted nylon piece 200g The cotton pieces were prepared with 5 boil-washes to remove any previous test treatment. The synthetic test pieces were given 5 60° C. washes. The pieces were stored according to fabric type in plastic bin bags.

3. The Terry towelling pieces were stapled to the ballast terry towels with nylon staples. In particular, two test pieces were stapled to each towel—one either side, and two staples were used along one edge of each test piece. This formed the test piece into a flap, and prevented it from balling up in the washing machine. The whole ballast load was then washed on programme 4 (50° C. with short spin).

4. The load was placed in a wash basket and the towels separated from the rest of the load. The rinse water was prepared in the Hotpoint 9400 machine in the normal way. The agitator was stopped, and the four towels were lowered flat into the four quarters of the drum. The agitator was started, and the rest of the wash load was added. The rest of the rinse/spin was completed.

5. After spinning, the test cloths were removed from the towels, and labelled in the normal way.

F. STATISTICAL DESIGN OF EXPERIMENT

Statistical design was used to identify and take into account the sources of variation likely to occur in the system. Comparisons between formulations were thus made with increased accuracy, and differences analyzed for significance.

The consistent experimental procedure described above avoided many possible variances arising from changes in method from test to test.

A series of 6 replicates (totally separate experiments using the above method) each using the same products, was carried out over 3 days - one morning and one afternoon treatment per day. Panel testing (see below) took place after a 24 hour drying/conditioning period. Such a design gave a measure of day to day and within day variation of results.

G. PANEL TESTING TO EVALUATE

A means of evaluating the softening action of a fabric conditioner was by a subjective assessment of 'handle' by a screened panel of testers.

1. Linecharts

A panel of eight people was used to assess the softness of the treated cloths. Each panellist was given, with each cloth to be tested, a sheet of paper, on which was marked a line (10.0cm length). The panellist was asked to indicate his/her perceived level of softness of the cloth by making an appropriate mark on the line (0.0cm was 'harsh', 10.0cm was 'soft'). A linechart was used in preference to a paired comparison as the mean values are directly related to softness and therefore gave a better idea of sample variability.

2. Testing Format

Each panellist received a set of cloths (the number of cloths depending on the number of quat mixtures tested) which he/she evaluated for softness. Each tester was given (over 3 days, morning and afternoon) a total of 6 sets of cloths from the 6 separate replicates (see statistical design).

3. Analysis of Results

Analysis of variance (F-test) was used to compare the various treatments. The least significant difference (lsd) was then used to compare the mean values for each treatment, any means differing by more than the lsd being significantly different.

Panellists' performance ie. the ability to discriminate and to be consistent was also monitored.

REWETTABILITY TEST METHOD

H. REWETTABILITY

Continued use of quaternary ammonium fabric conditioners after every wash cycle gives a degree of build up of quat on the fabric. Such a build up of hydrophobic softener may result in a reduction of water adsorption by the treated cloth, an undesirable situation especially in napkins or towels.

Methods used to study this loss of rewettability include weighing cloths after immersing in water for a given time, and measuring times taken for treated cloths to sink. A more reliable method, and the one used here, was the rate of wicking of an aqueous dye solution along suspended strips of Terry towelling.

I. TEST METHOD

1. Treatment of Cloths

Cloths (Terry towelling, 400gsm, bleached only) were desized using 5 wash cycles on programme 1 (90 minutss approx) at 95° C. (Miele machine), and tumble dried on programme 1 (Miele drier).

8 of the 9"×9" cloths were washed on programme 4 at 50° C., using 120g of NSPA, followed by a short spin. 20g of quat solution was stirred manually into 51 tap water and the cloths immersed for 10 minutes, stirring at intervals of 1 minute. The cloths were removed, squeezed gently, and hung dried in the laboratory. Each cloth was cut into 5 strips.

2. Wicking Test

Ten strips were suspended in a Lissamine Red dye solution (0.2%) with approx. 3 cm immersed and the height reached by the dye solution after 5 and 10 minutes was recorded for each strip. The experiment was performed a total of four times.

3. Build up of quat

To investigate the effect of build up of quat after several wash/rinses on rewettability, the cloths ware washed/rinsed/tumble dried six times before the wicking test.

J. RESULTS OBTAINED USING THE ABOVE PRODUCTS (under typical domestic conditions)

1. Comparison of softening performance using 5% quat, 3% quat, 3% quat +0.3% sample X, 3% quat +0.3% sample W Treatment of cloths with the above quat mixtures gave the following results:

| 5% Quat | 3% + 0.3% Sample W | 3% + 0.3% Sample X | 3% Quat |
|---|---|---|---|
| 5.4 | 5.2 | 4.8 | 4.2 |

Treatment with 3% quat +0.3% sample W gave softening performance statistically indistinguishable from treatment with 5% quat, and significantly better than treatment with 3% quat (at 95% confidence level). Sample X was also better than 3% quat alone.

Levels of Sample W

Incorporation of Sample W at 0.25% gave reduced softening performance than that observed when using 0.3% of Sample W. However, no improvement in softening was obtained if 0.3% Sample W increased to 0.375% or 0.5%.

Other siloxanes

3% quat +0.3% Sample Y or Sample Z gave improved softening performance over 3% quat alone.

2. Rewettability

Under the standardised method (see above) 2 sets of results were obtained—one for cloths treated once only and another set for cloths washed, treated and dried 6 times (to test for adverse build up effects).

(a) One treatment only

The mean height (cm) travelled by the dye, for each product treatment, is shown below:

| 5% quat | 3% quat | 3% quat + 0.3% Sample W |
|---|---|---|
| 8.0 | 9.5 | 10.3 |

The lsd =0.3cm. which gives strong evidence of a difference between the three treatments.

(b) Six treatments

The mean heights travelled were:

| 5% quat | 3% quat | 3% quat + 0.3% Sample W |
|---|---|---|
| 11.3 | 12.1 | 13.0 |

The lsd=0.5cm, again there is strong evidence of a difference between the three treatments.

Cloths treated with 3% quat +0.3% Sample W show not only the improvement in rewettability caused by reduction in quat level from 5% to 3%, but a further significant increase in water absorbency for both once and six times treated cloths.

I claim:

1. An aqueous based fabric conditioning formulation comprising a water dispersible cationic softener a nonionic softener and optionally an electrolyte, characterised in that the water-dispersible cationic softener is selected from the quaternary ammonium halides and the imidazolinium methosulphates and the non-ionic softener

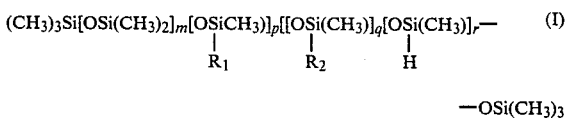

(I)

wherein $R_1=(CH_2)_tCH_3$ $R_2$=—H, $CH_3$ or $—(CH_2)_z(OCH_2CHR_3)_x(OCH_2CHR_4)_y—OR_5$ in which each of $R_3$ and $R_4$ represent an H or a $—CH_3$ group such that the resultant polyoxyalkylene derivative is a polymer of that the resultant polyoxyalkylene derivative is a polymer of ethylene oxide, or, a random and/or block copolymer of ethylene oxide and propylene oxide, $R_5$=H, $C_1$–$C_4$ alkyl or an acetoxy group, x=1–50 y=0–40 z=1–10 t=5–21 m=5–1000 n=1–100 q=1–50 and r=1)–50.

2. A formulation according to claim 1 wherein in the compounds of the formula (I):

m=10–120 p=5–40 q=1–6 r=1.5 x=5–15 y=1–10 z=2–5

$R_3$=H $R_4$ is $—CH_3$, and $R_5$ is H or $—CH_3$.

3. An aqueous based fabric conditioning formulation according to claim 1, said formulation comprising:

(a) a water-dispersible cationic softener selected from (i) dihydrocarbyldialkylammonium salt of the formula:

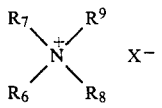

(II)

wherein $R_6$ and $R_7$ are the same or different $C_8$ to $C_{24}$ alkyl or alkenyl groups, which may optionally carry additional functional groups selected from —OH, —0—, —CONH and —COO—either as substituents or as part of the main alkyl or alkenyl chain, $R_7$ and $R_8$ are the same or different $C_1$–$C_4$ alkyl hydroxyalkyl or (poly)oxyalkylene groups, and $X^-$ is an anion selected from a halide, methosulphate and ethosulphate, (ii) an alkylimidazolinium salt of the formula (III):

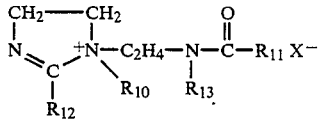

(III)

wherein $R_{10}$ is a $C_1$–$C_4$ alkyl or hydroxyalkyl or (poly-)oxyalkylene group, $R_{11}$ and $R_{12}$ are the same or different alkyl or alkenyl groups containing from 8 to 24 carbon atoms, and $R_{13}$ is hydrogen, a $C_1$–$C_4$ alkyl or a $—CO—R_{11}$ group and $X^-$ is an anion, selected from a halide, methosulphate or ethosulphate, (iii)

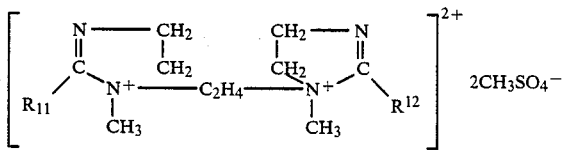

(IV)

(iv)

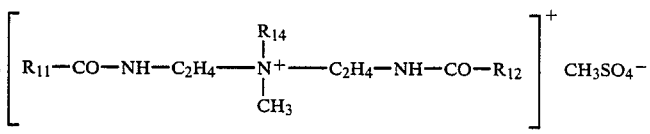

(V)

wherein $R_{14}$=H, alkyl, hydroxyalkyl or (poly)oxyalkylene and (b) a siloxane of formula (I) and optionally (c) an electrolyte.

4. A formulation according to claim 4 wherein in the component (a) represented by formula (II), each of $R_6$ and $R_7$ is a substituent in which more than 50% of the groups are $C_{16}$ or $C_{18}$ alkyl or alkenyl groups.

5. A formulation according to claim 3 wherein in the component (a) represented by formula (II), each of the substituent groups $R_6$ and $R_7$ represent a mixture of alkyl and alkenyl groups, whereby from 50–90% are $C_{18}$ alkyl or alkenyl groups and from 10 to 50% are $C_{16}$ alkyl or alkenyl groups.

6. A formulation according to claim 3 wherein in the component (a) represented by formula (II), the substituents $R_6$ and $R_7$ are dioctadecyl groupings, the substituents $R_8$ and $R_9$ are methyl groups, and the anion $X^-$ is a chloride.

7. A formulation according to claim 3 wherein the components (a) and (b) are present in the following percentages by weight based on the total weight of (a) and (b):

(a) 40% to 98%

(b) 2% to 60%

8. A formulation according to claim 3 wherein the formulation is prepared as a preblend of (a) and (b) by mixing (b) with molten (a) at a temperature in the range 40° to 70° C.

9. A formulation according to claim 3 wherein said formulation is prepared as a preblend of (a) and (b) by mixing (b) with molten (a) and dispersed in water with moderate shearing at a temperature in the range 40° to 70° C.

10. A formulation according to claim 9 wherein the total amount of components (a) and (b) dispersed in water is from 2–10% w/w.

11. An aqueous based fabric conditioning formulation as claimed in claim 1 wherein $R_2$ in Formula (I) is $-(CH_2)_z(OCH_2CHR_3)_x(OCH_2CHR_4)_Y-OR_5$.

12. An aqueous based fabric conditioning formulation as claimed in claim 4 wherein $R_2$ in Formula I is $-(CH_2)_z(OCH_2CHR_3)_x(OCH_2CHR_4)_y-OR_5$.

* * * * *

UNITED STATES PATENT AND TRADEMARK OFFICE

CERTIFICATE OF CORRECTION

PATENT NO. : 4,933,097

DATED : June 12, 1990

INVENTOR(S) : SANDRA A. KEEGAN

It is certified that error appears in the above-identified patent and that said Letters Patent is hereby corrected as shown below:

Col. 2, l. 2, should read "Si$(CH_3)$(H)-"

Col. 3, l. 49, should read "2-lauryl-"

Col. 6, l. 3, insert a title to the table, reading: "Results"

Col. 6, l. 38, should read "D=OSi$(CH_3)_2$ groups"

Col. 6, l. 39, should read "$D^1$=OSi$(CH_3)(R_1)$ groups"

Col. 7, l. 31, should read "1. 100 cloths"

Col. 8, l. 10, correct spelling of the word "pieces"

Col. 10, l. 10, insert a title before the table, reading: "Mean scores for softness of treated clothes:"

Col. 11, l. 3, should read "softener comprises a siloxane of the formula:"

UNITED STATES PATENT AND TRADEMARK OFFICE

CERTIFICATE OF CORRECTION

PATENT NO. : 4,933,097

DATED : June 12, 1990

INVENTOR(S) : Sandra A. Keegan

It is certified that error appears in the above-identified patent and that said Letters Patent is hereby corrected as shown below:

Claim 1, col. 11, l. 42, should read "r=1-50"

Claim 2, col. 11, l. 49, should read "r=1-5"

Claim 3, col. 12, l. 39, insert a comma (,) after "(I)"

Signed and Sealed this

Nineteenth Day of November, 1991

*Attest:*

HARRY F. MANBECK, JR.

*Attesting Officer*

*Commissioner of Patents and Trademarks*